US008202237B2

(12) United States Patent
Helgeson et al.

(10) Patent No.: US 8,202,237 B2
(45) **Date of Patent: *Jun. 19, 2012**

(54) PORTABLE AIR PULSATOR AND THORACIC THERAPY GARMENT

(75) Inventors: Lonnie J. Helgeson, New Prague, MN (US); Michael W. Larson, New Prague, MN (US)

(73) Assignee: Electromed, Inc., New Prague, MN (US)

( * ) Notice: Subject to any disclaimer, the term of this patent is extended or adjusted under 35 U.S.C. 154(b) by 714 days.

This patent is subject to a terminal disclaimer.

(21) Appl. No.: 12/386,543

(22) Filed: Apr. 21, 2009

(65) Prior Publication Data

US 2009/0234256 A1 Sep. 17, 2009

Related U.S. Application Data

(63) Continuation-in-part of application No. 11/906,793, filed on Oct. 3, 2007.

(51) Int. Cl.
*A61H 7/00* (2006.01)
*A61H 19/00* (2006.01)

(52) U.S. Cl. ..... 601/152

(58) Field of Classification Search ..... 601/89, 601/107, 148–152

See application file for complete search history.

(56) References Cited

U.S. PATENT DOCUMENTS 1,147,560 A * 7/1915 Shurtleff ..... 601/152
1,898,652 A 2/1933 Williams
2,223,570 A 12/1940 McMillin
2,354,397 A 7/1944 Miller
2,529,258 A 11/1950 Lobo
2,575,398 A 11/1951 Schoeder
2,588,192 A 3/1952 Akerman et al.
2,626,601 A 1/1953 Riley
2,648,325 A 8/1953 Siple
2,707,948 A 5/1955 Emerson
2,762,200 A 9/1956 Huxley, III
2,762,366 A 9/1956 Huxley, III et al.
2,779,329 A 1/1957 Huxley, III et al.
2,780,222 A 2/1957 Polzin et al.
2,869,537 A 1/1959 Chu
2,899,955 A 8/1959 Huxley, III et al.
2,918,917 A 12/1959 Emerson
3,029,743 A 4/1962 Johns
3,043,292 A 7/1962 Mendelson
3,063,444 A 11/1962 Jobst
3,078,842 A 2/1963 Gray
3,120,228 A 2/1964 Huxley, III
3,164,100 A 1/1965 Hughes
3,179,106 A 4/1965 Meredith
3,288,132 A 11/1966 Meredith
3,307,533 A 3/1967 Meredith et al.
3,310,050 A 3/1967 Goldfarb
3,545,017 A 12/1970 Cohn
3,566,862 A 3/1971 Schuh et al.
3,577,977 A 5/1971 Ritzinger, Jr et al.
3,683,655 A 8/1972 White et al.
(Continued)

*Primary Examiner* — Kristen Matter
(74) *Attorney, Agent, or Firm* — Richard John Bartz

(57) ABSTRACT

A portable human body pulsating apparatus has an air pulse generator mounted on a pedestal having wheels to facilitate movement of the apparatus on a surface. The pedestal has an upright piston and cylinder assembly operable to adjust the elevation of the air pulse generator. A reversible thoracic therapy garment is connected with a hose to an air pulse generator which can be selectively located adjacent opposite sides of a person receiving therapy.

16 Claims, 12 Drawing Sheets

U.S. PATENT DOCUMENTS 3,760,801 A 9/1973 Borgeas
3,885,554 A 5/1975 Rockwell, Jr.
3,896,794 A 7/1975 McGrath
3,993,053 A 11/1976 Grossan
4,004,579 A 1/1977 Dedo
4,120,297 A 10/1978 Rabischong et al.
4,135,503 A 1/1979 Romano
4,178,922 A 12/1979 Curlee
4,186,732 A 2/1980 Christoffel
4,239,039 A 12/1980 Thompson
4,372,297 A * 2/1983 Perlin ..... 601/151
4,375,217 A 3/1983 Arkans
4,402,312 A 9/1983 Villari et al.
4,424,806 A 1/1984 Newman et al.
4,481,944 A 11/1984 Brunnell
4,523,579 A 6/1985 Barry
4,538,604 A 9/1985 Usry et al.
4,577,626 A 3/1986 Marukawa et al.
4,590,925 A 5/1986 Dillon
4,621,621 A 11/1986 Marasalis
4,637,074 A 1/1987 Taheri
4,676,232 A 6/1987 Olsson et al.
4,682,588 A 7/1987 Curlee
4,805,612 A 2/1989 Jensen
4,815,452 A 3/1989 Hayek
4,838,263 A 6/1989 Warwick et al.
4,840,167 A 6/1989 Olsson et al.
4,928,674 A 5/1990 Halperin et al.
4,930,498 A 6/1990 Hayek
4,952,095 A 8/1990 Walters
4,977,889 A 12/1990 Budd
4,979,375 A 12/1990 Nathans et al.
5,007,412 A 4/1991 DeWall
5,055,052 A 10/1991 Johnsen
5,056,505 A 10/1991 Warwick et al.
5,222,478 A 6/1993 Scarberry et al.
5,235,967 A 8/1993 Arbisi et al.
5,245,990 A 9/1993 Bertinin
5,269,659 A 12/1993 Hampton et al.
5,370,603 A 12/1994 Newman
5,453,081 A 9/1995 Hansen
5,490,820 A 2/1996 Schock et al.
5,494,469 A 2/1996 Heath et al.
5,569,170 A 10/1996 Hansen
5,606,754 A 3/1997 Hand et al.
D379,396 S 5/1997 Rongo et al.
5,674,269 A 10/1997 Augustine
5,769,797 A 6/1998 Van Brunt et al.
5,769,800 A 6/1998 Gelfand et al.
5,800,489 A 9/1998 Augustine
5,836,751 A 11/1998 De Villiers
5,938,627 A 8/1999 Hickman
6,030,353 A 2/2000 Van Brunt
6,036,662 A 3/2000 Van Brunt et al.
6,155,996 A 12/2000 Van Brunt et al.
6,254,556 B1 7/2001 Hansen et al.
6,379,316 B1 4/2002 Van Brunt et al.
D456,591 S 5/2002 Hansen et al.
D461,897 S 8/2002 Hansen et al.
6,471,663 B1 10/2002 Van Brunt et al.
6,488,641 B2 12/2002 Hansen
D469,876 S 2/2003 Hansen et al.
6,547,749 B2 4/2003 Hansen
D478,989 S 8/2003 Hansen et al.
6,605,050 B2 8/2003 Hansen
6,676,614 B1 1/2004 Hansen et al.
6,958,046 B2 10/2005 Warwick et al.
7,278,978 B1 10/2007 Hansen et al.
7,374,550 B2 5/2008 Hansen et al.
2004/0097843 A1 5/2004 Van Brunt et al.
2005/0143796 A1 6/2005 Augustine et al.

* cited by examiner

PORTABLE AIR PULSATOR AND THORACIC THERAPY GARMENT

CROSS REFERENCE TO RELATED APPLICATION

This application is a continuation-in-part of U.S. patent application Ser. No. 11/906,793 filed Oct. 3, 2007.

FIELD OF THE INVENTION

The invention relates to a portable medical device operable with a thoracic therapy garment to apply repetitive compression forces to the body of a person to aid blood circulation, loosen and eliminate mucus from the lungs and trachea and relieve muscular and nerve tensions.

BACKGROUND OF THE INVENTION

Clearance of mucus from the respiratory tract in healthy individuals is accomplished primarily by the body's normal mucociliary action and cough. Under normal conditions these mechanisms are very efficient. Impairment of the normal mucociliary transport system or hypersecretion of respiratory mucus results in an accumulation of mucus and debris in the lungs and can cause severe medical complications such as hypoxemia, hypercapnia, chronic bronchitis and pneumonia. These complications can result in a diminished quality of life or even become a cause of death. Abnormal respiratory mucus clearance is a manifestation of many medical conditions such as pertussis, cystic fibrosis, atelectasis, bronchiectasis, cavitating lung disease, vitamin A deficiency, chronic obstructive pulmonary disease, asthma, and immotile cilia syndrome. Exposure to cigarette smoke, air pollutants and viral infections also adversely affect mucociliary function. Post surgical patients, paralyzed persons, and newborns with respiratory distress syndrome also exhibit reduced mucociliary transport.

Chest physiotherapy has had a long history of clinical efficacy and is typically a part of standard medical regimens to enhance respiratory mucus transport. Chest physiotherapy can include mechanical manipulation of the chest, postural drainage with vibration, directed cough, active cycle of breathing and autogenic drainage. External manipulation of the chest and respiratory behavioral training are accepted practices. The various methods of chest physiotherapy to enhance mucus clearance are frequently combined for optimal efficacy and are prescriptively individualized for each patient by the attending physician.

Cystic fibrosis (CF) is the most common inherited life-threatening genetic disease among Caucasians. The genetic defect disrupts chloride transfer in and out of cells, causing the normal mucus from the exocrine glands to become very thick and sticky, eventually blocking ducts of the glands in the pancreas, lungs and liver. Disruption of the pancreatic glands prevents secretion of important digestive enzymes and causes intestinal problems that can lead to malnutrition. In addition, the thick mucus accumulates in the lung's respiratory tracts, causing chronic infections, scarring, and decreased vital capacity. Normal coughing is not sufficient to dislodge these mucus deposits. CF usually appears during the first 10 years of life, often in infancy. Until recently, children with CF were not expected to live into their teens. However, with advances in digestive enzyme supplementation, anti-inflammatory therapy, chest physical therapy, and antibiotics, the median life expectancy has increased to 30 years with some patients living into their 50s and beyond. CF is inherited through a recessive gene, meaning that if both parents carry the gene, there is a 25 percent chance that an offspring will have the disease, a 50 percent chance they will be a carrier and a 25 percent chance they will be genetically unaffected. Some individuals who inherit mutated genes from both parents do not develop the disease. The normal progression of CF includes gastrointestinal problems, failure to thrive, repeated and multiple lung infections, and death due to respiratory insufficiency. While some patients experience grave gastrointestinal symptoms, the majority of CF patients (90 percent) ultimately succumb to respiratory problems.

Virtually all patients with CF require respiratory therapy as a daily part of their care regimen. The buildup of thick, sticky mucus in the lungs clogs airways and traps bacteria, providing an ideal environment for respiratory infections and chronic inflammation. This inflammation causes permanent scarring of the lung tissue, reducing the capacity of the lungs to absorb oxygen and, ultimately, sustain life. Respiratory therapy must be performed, even when the patient is feeling well, to prevent infections and maintain vital capacity. Traditionally, care providers perform Chest Physical Therapy (CPT) one to four times per day. CPT consists of a patient lying in one of twelve positions while a caregiver "claps" or pounds on the chest and back over each lobe of the lung. To treat all areas of the lung in all twelve positions requires pounding for half to three-quarters of an hour along with inhalation therapy. CPT clears the mucus by shaking loose airway secretions through chest percussions and draining the loosened mucus toward the mouth. Active coughing is required to ultimately remove the loosened mucus. CPT requires the assistance of a caregiver, often a family member but a nurse or respiratory therapist if one is not available. It is a physically exhausting process for both the CF patient and the caregiver. Patient and caregiver non-compliance with prescribed protocols is a well-recognized problem that renders this method ineffective. CPT effectiveness is also highly technique sensitive and degrades as the giver becomes tired. The requirement that a second person be available to perform the therapy severely limits the independence of the CF patient.

Persons confined to beds and chairs having adverse respiratory conditions, such as CF and airway clearance therapy, are treated with pressure pulsating devices that subject the person's thorax with high frequency pressure pulses to assist the lung breathing functions and blood circulation. The pressure pulsating devices are operatively coupled to thoracic therapy garments adapted to be worn around the person's upper body. In hospital, medical clinic, and home care applications patients require easy application and low cost disposable thoracic garments connectable to portable air pressure pulsating devices that can be selectively located adjacent the left or right side of the patients.

Artificial respiration devices for applying and relieving pressure on the chest of a person have been used to assist in lung breathing functions, and loosening and eliminating mucus from the lungs of CF persons. Subjecting the person's chest and lungs to pressure pulses or vibrations decreases the viscosity of lung and air passage mucus, thereby enhancing fluid mobility and removal from the lungs. An example of a body pulsating method and device disclosed by C. N. Hansen in U.S. Pat. No. 6,547,749, incorporated herein by reference, has a case accommodating an air pressure and pulse generator. A handle pivotally mounted on the case is used as a hand grip to facilitate transport of the generator. The case including the generator must be carried by a person to different locations to provide treatment to individuals in need of respiratory therapy. These devices use vests having air-accommodating bladders that surround the chests of persons. An example of a vest used with a body pulsating device is disclosed by C. N.

Hansen and L. J. Helgeson in U.S. Pat. No. 6,676,614. The vest is used with an air pressure and pulse generator. Mechanical mechanisms, such as solenoid or motor-operated air valves, bellows and pistons are disclosed in the prior art to supply air under pressure to diaphragms and bladders in regular pattern or pulses. Manually operated controls are used to adjust the pressure of the air and air pulse frequency for each patient treatment and during the treatment. The bladder worn around the thorax of the CF person repeatedly compresses and releases the thorax at frequencies as high as 25 cycles per second. Each compression produces a rush of air through the lobes of the lungs that shears the secretions from the sides of the airways and propels them toward the mouth where they can be removed by normal coughing. Examples of chest compression medical devices are disclosed in the following U.S. patents.

W. J. Warwick and L. G. Hansen in U.S. Pat. Nos. 4,838,263 and 5,056,505 disclose a chest compression apparatus having a chest vest surrounding a person's chest. A motor-driven rotary valve located in a housing located on a table allows air to flow into the vest and vent air therefrom to apply pressurized pulses to the person's chest. An alternative pulse pumping system has a pair of bellows connected to a crankshaft with rods operated with a dc electric motor. The speed of the motor is regulated with a controller to control the frequency of the pressure pulses applied to the vest. The patient controls the pressure of the air in the vest by opening and closing the end of an air vent tube. The apparatus must be carried by a person to different locations to provide treatment to persons in need of respiratory therapy.

M. Gelfand in U.S. Pat. No. 5,769,800 discloses a vest design for a cardiopulmonary resuscitation system having a pneumatic control unit equipped with wheels to allow the control unit to be moved along a support surface.

N. P. Van Brunt and D. J. Gagne in U.S. Pat. Nos. 5,769,797 and 6,036,662 disclose an oscillatory chest compression device having an air pulse generator including a wall with an air chamber and a diaphragm mounted on the wall and exposed to the air chamber. A rod pivotally connected to the diaphragm and rotatably connected to a crankshaft transmits force to the diaphragm during rotation of the crankshaft. An electric motor drives the crankshaft at selected controlled speeds to regulate the frequency of the air pulses generated by the moving diaphragm. A blower delivers air to the air chamber to maintain the pressure of the air in the chamber. Controls for the motors that move the diaphragm and rotate the blower are responsive to the air pressure pulses and pressure of the air in the air chamber. These controls have air pulse and air pressure responsive feedback systems that regulate the operating speeds of the motors to control the pulse frequency and air pressure in the vest. The air pulse generator is a mobile unit having a handle and a pair of wheels.

SUMMARY OF THE INVENTION

The invention is a medical device used to deliver high-frequency chest wall oscillations to promote airway clearance and improve bronchial drainage in humans. The primary components of the device include an air-pulse generator, an air inflatable thoracic garment, and a flexible hose coupling the air-pulse generator to the thoracic garment for transmitting air pressure and pressure pulses from the generator to the thoracic garment. The air-pulse generator is mounted on a portable pedestal having wheels that allow the generator to be moved to different locations to provide therapy treatments to a number of persons. The portable pedestal allows the air-pulse generator to be located adjacent opposite sides of a person confined to a bed or chair. The pedestal includes a linear lift that allows the elevation or height of the air-pulse generator to be adjusted to accommodate different locations and persons. The air-pulse generator includes a housing supporting generator controls for convenient use. The housing has a top handle used to manually transport the air-pulse generator. The housing is supported on and secured to a frame assembly joined to the top of the pedestal. The frame assembly has parallel horizontal members connected to a platform engaging the bottom of the housing of the air-pulse generator. Upright members joined to the horizontal members are fastened to opposite sides of the housing of the air-pulse generator. U-shaped handles joined to and extended outwardly from the upright members provide handles to facilitate movement of the pedestal and air-pulse generator.

The thoracic therapy garment has an elongated flexible body having a plurality of elongated generally parallel chambers for accommodating air. An air inlet connector joined to a lower portion of the body is releasably coupled to a flexible hose joined to the air pulse outlet of the air-pulse generator. One end of the body has hook pads secured to opposite sides of the end to allow the garment to be selectively placed around a person's thorax in clockwise and counterclockwise positions. The outside surface to the body has a loop texture that coacts with the hook pads to retain the garment firmly around the person's thorax. The thoracic therapy garment is reversible with a single air inlet connector that can be accessed from either side of a person's bed or chair. The upper portions of the body have concave arm contours that allow the therapy garment to cover upper thorax areas.

DESCRIPTION OF INVENTION

Figure 1:
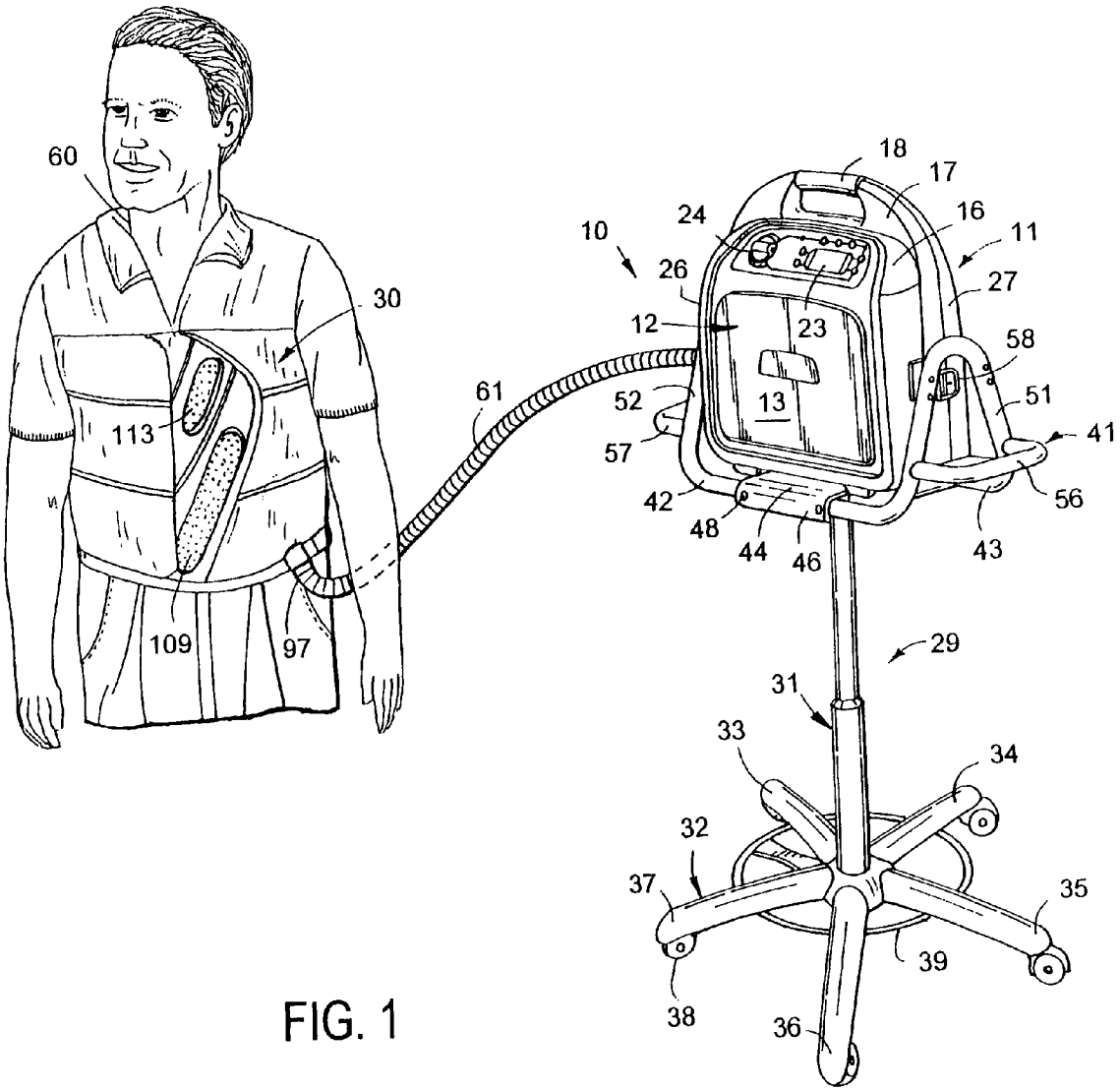
FIG. 1 is a perspective view of a thoracic therapy garment located around the thorax of a person connected with a hose to a pedestal mounted air-pulse generator located on the left side of the person.
Figure 2:
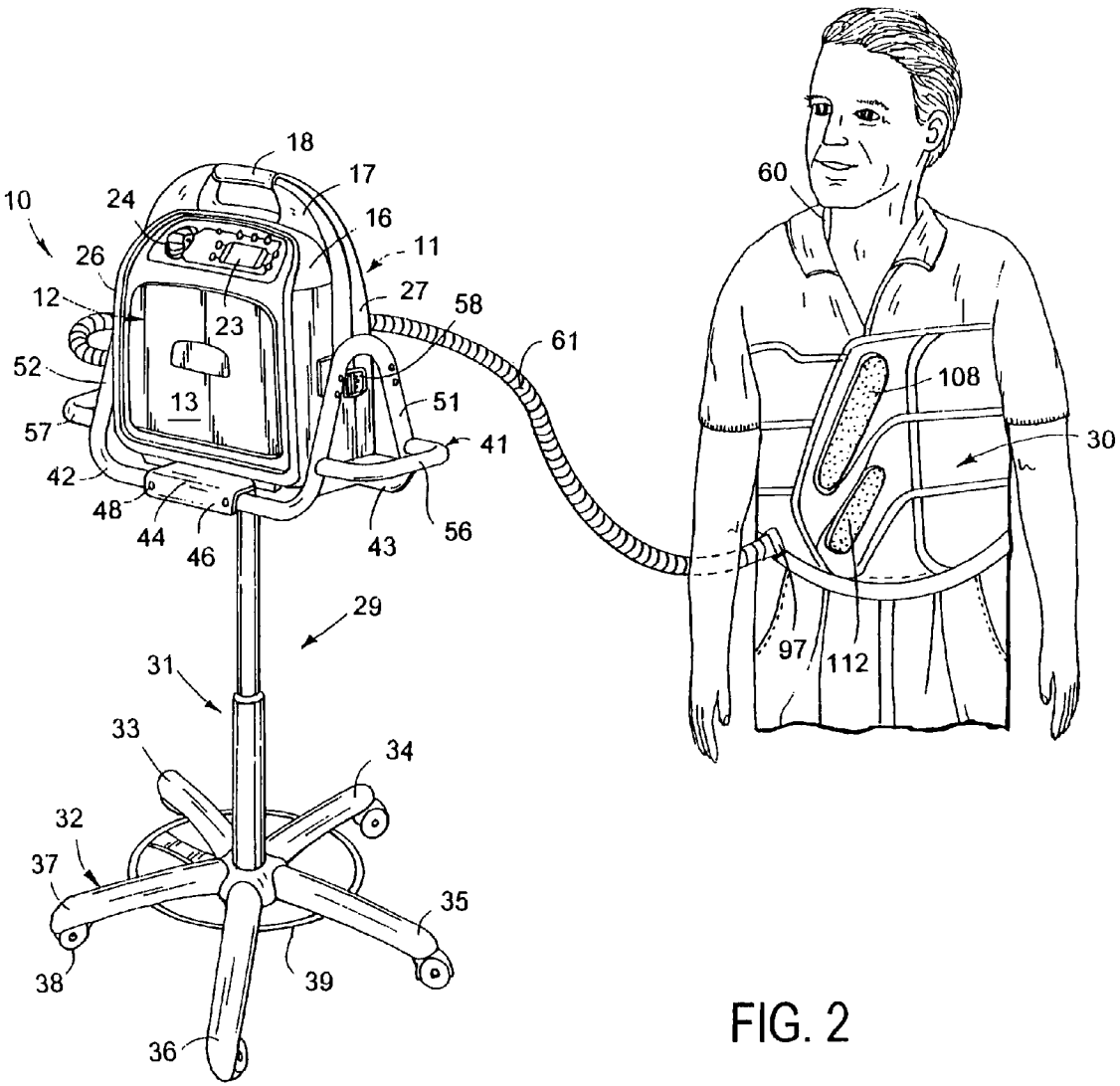
FIG. 2 is a perspective view of the thoracic therapy garment of FIG. 1 located around the thorax of a person connected with a hose to a pedestal mounted air-pulse generator located on the right side of the person.

A portable human body pulsating apparatus 10, shown in FIGS. 1 and 2, comprises an air-pulse generator 11 having a housing 12. A movable pedestal 29 supports generator 11 and housing 12 on a surface, such as a floor. Pedestal 29 allows respiratory therapists and patient care persons to transport the entire human body pulsating apparatus to different locations accommodating a number of persons in need of respiratory therapy and to storage locations.

Human body pulsating apparatus 10 is used with a thoracic therapy garment 30 to apply repetitive pressure pulse to a person's thorax to provide secretion and mucus clearance therapy. Respiratory mucus clearance is applicable to many medical conditions, such as pertussis, cystic fibrosis, atelectasis, bronchiectasis, cavitating lung disease, vitamin A deficiency, chronic obstructive pulmonary disease, asthma, and immobile cilia syndrome. Post surgical patients, paralyzed persons, and newborns with respiratory distress syndrome have reduced mucociliary transport. Apparatus 10 provides high frequency chest wall oscillations or pulses to enhance mucus and airway clearance in a person with reduced mucociliary transport. High frequency pressure pulses subjected to the thorax in addition to providing respiratory therapy to a person's lungs and trachea, also stimulates the heart and blood flow in arteries and veins in the chest cavity. Muscular and nerve tensions are also relieved by the repetitive pressure pulses imparted to the front, sides, and back portions of the thorax. The lower part of the thoracic cage comprises the abdominal cavity which reaches upward as high as the lower tip of the sternum so as to afford considerable protection to the large and easily injured abdominal organs, such as the liver, spleen, stomach, and kidneys. The abdominal cavity is only subjected to very little high frequency pressure pulses.

Housing 12 is a generally rectangular member having a front wall 13 and side walls 26 and 27 joined to a top wall 16. An arched member 17 having a horizontal handle 18 extended over top wall 16 is joined to opposite portions of top wall 16 whereby handle 18 can be used to manually carry air-pulse generator 11 and facilitate mounting air-pulse generator 11 on pedestal 29. A control panel 23 mounted on top wall 16 has time control keys and frequency control keys located on opposite sides of a visual control screen. An air pressure control knob 24 is located on the left side of panel 23. The control keys, screen and air pressure control knob are in locations that are readily accessible by the respiratory therapists and user of apparatus 10. The operating elements and functions and controls of air-pulse generator 11 are disclosed by C. N. Hansen, P. E. Cross and L. T. Helgeson in U.S. Patent Application Publication No. 2005/0235988 and incorporated herein by reference. Alternative air pulse generators are disclosed by C. N. Hansen in U.S. Pat. Nos. 6,488,641 and 6,547,749, incorporated herein by reference.

Person care homes, assisted living facilities and clinics can accommodate a number of persons in different rooms or locations that require respiratory therapy or high frequency chest wall oscillations as medical treatments. The portable pulsating apparatus 10 can be manually moved to required locations and connected with a flexible hose 61 to a thoracic therapy garment 30 located around a person's thorax. As shown in FIGS. 1 and 2, pulsating apparatus 10 can be selectively located adjacent the left or right side of a person 60 who may be confined to a bed or chair.

Pedestal 29 has an upright gas operated piston and cylinder assembly 31 mounted on a base 32 having outwardly extended legs 33, 34, 35, 36 and 37. Other types of linear expandable and contractible devices can be used to change the location of generator 11. Caster wheels 38 are pivotally mounted on the outer ends of legs 33-37 to facilitate movement of body pulsating apparatus 10 along a support surface. One or more wheels 38 are provided with releasable brakes to hold apparatus 10 in a fixed location. An example of a pedestal is disclosed in U.S. Pat. No. 5,366,275. The piston and cylinder assembly 31 is linearly extendable to elevate air-pulse generator 11 to a height convenient to the respiratory therapist or user. A gas control valve having a foot operated ring lever 39 is used to regulate the linear extension of piston and cylinder assembly 31 and resultant elevation of generator 11. Generator 11 can be located in positions between its up and down positions. Lever 39 and gas control valve are operative associated with the lower end of piston and cylinder assembly 31.

A frame assembly 41 having parallel horizontal members 42 and 43 and a platform 44 mounts housing 12 on top of upright piston and cylinder assembly 31. The upper member of piston and cylinder assembly 31 is secured to the middle of platform 44. The opposite ends 46 of platform 44 are turned down over horizontal members 42 and 43 and secured thereto with fasteners 48. Upright inverted U-shaped arms 51 and 52 joined to opposite ends of horizontal members 42 and 43 are located adjacent opposite side walls 26 and 27 of housing 12. U-shaped handles 56 and 57 are joined to and extend outwardly from arms 51 and 52 provide hand grips to facilitate manual movement of the air-pulse generator 11 and pedestal 29 on a floor or carpet. An electrical female receptacle 58 mounted on side wall 27 faces the area surrounded by arm 51 so that arm 51 protects the male plug (not shown) that fits into receptacle 58 to provide electric power to air-pulse generator 11. A tubular air outlet sleeve is mounted on side wall 26 of housing 12. Hose 61 leading to thoracic therapy garment 30 telescopes into the sleeve to allow air and air pressure pulses to travel through hose 61 to thoracic therapy garment 30 to apply pressure pulses to a person's body.

Figure 3:
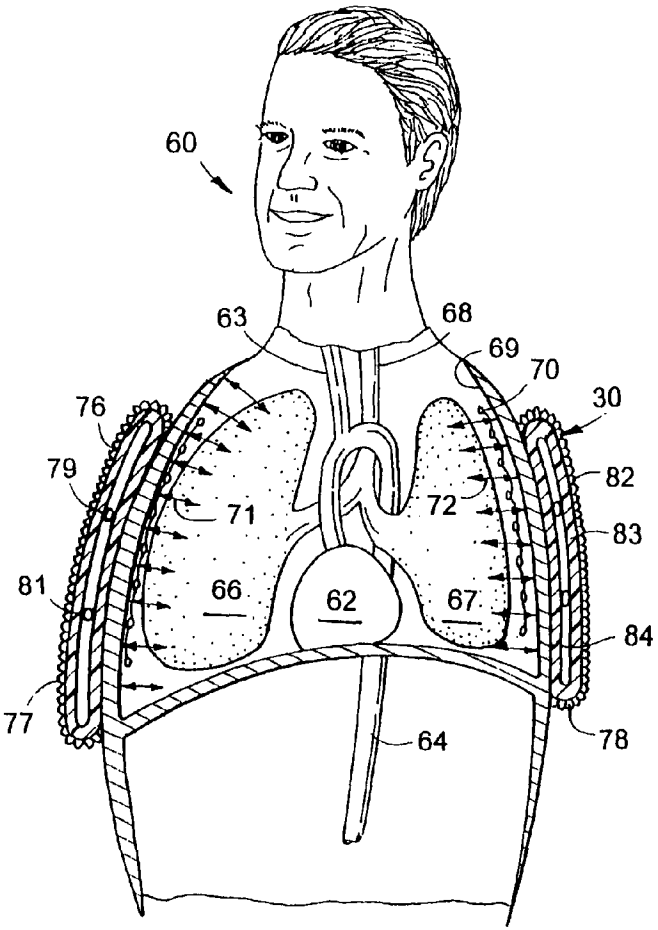
FIG. 3 is a front elevational view, partly sectioned, of the thoracic therapy garment of FIG. 1 located around the thorax of a person.

Thoracic therapy garment 30, shown in FIG. 3, is located around the person's thorax 69 in substantial surface contact with the entire circumference of thorax 69. Thoracic therapy garment 30 functions to apply repeated high frequency compression or pressure pulses, shown by arrows 71 and 72, to the person's lungs 66 and 67 and trachea 68. The reaction of lungs 66 and 67 and trachea 68 to the pressure pulses causes repetitive expansion and contraction of the lung tissue resulting in secretions and mucus clearance therapy. The thoracic cavity occupies only the upper part of the thoracic cage which contains lungs 66 and 67, heart 62, arteries 63 and 64, and rib cage 70. The high frequency pressure pulses applied to thorax 69 stimulates heart 62 and blood flow in arteries 63 and 64 and veins in the chest cavity. Rib cage 70 also aids in the distribution of the pressure pulses to lungs 66 and 67 and trachea 68.

Figure 5:
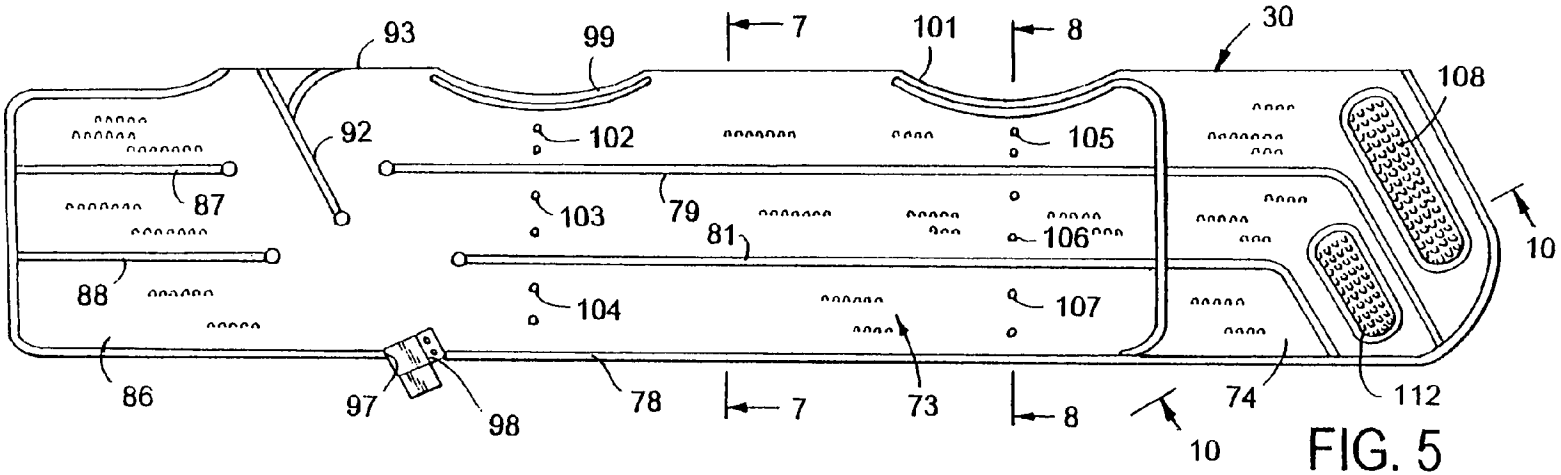
FIG. 5 is a linear front elevational view of the thoracic therapy garment of FIG. 1.
Figure 6:
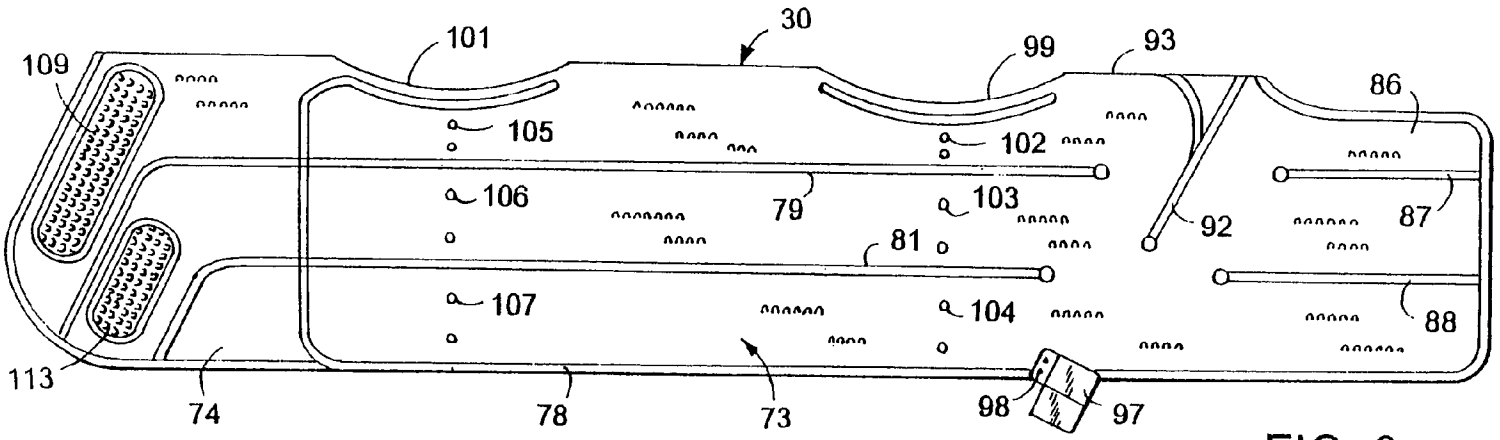
FIG. 6 is a linear rear elevational view of the thoracic therapy garment of FIG. 1.
Figure 8:
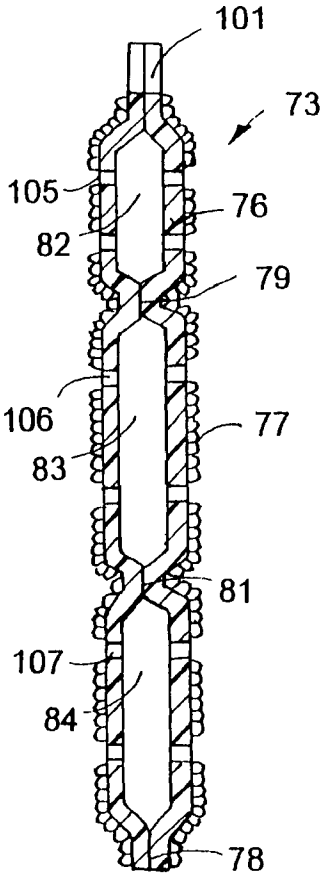
FIG. 8 is an enlarged sectional view taken along the line 8-8 of FIG. 5.
Figure 7:
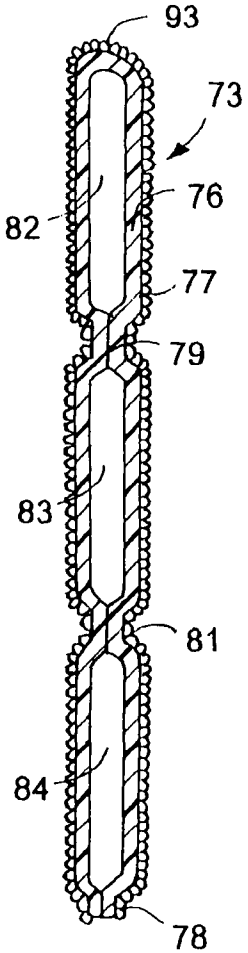
FIG. 7 is an enlarged sectional view taken along the line 7-7 of FIG. 5.
Figure 9:
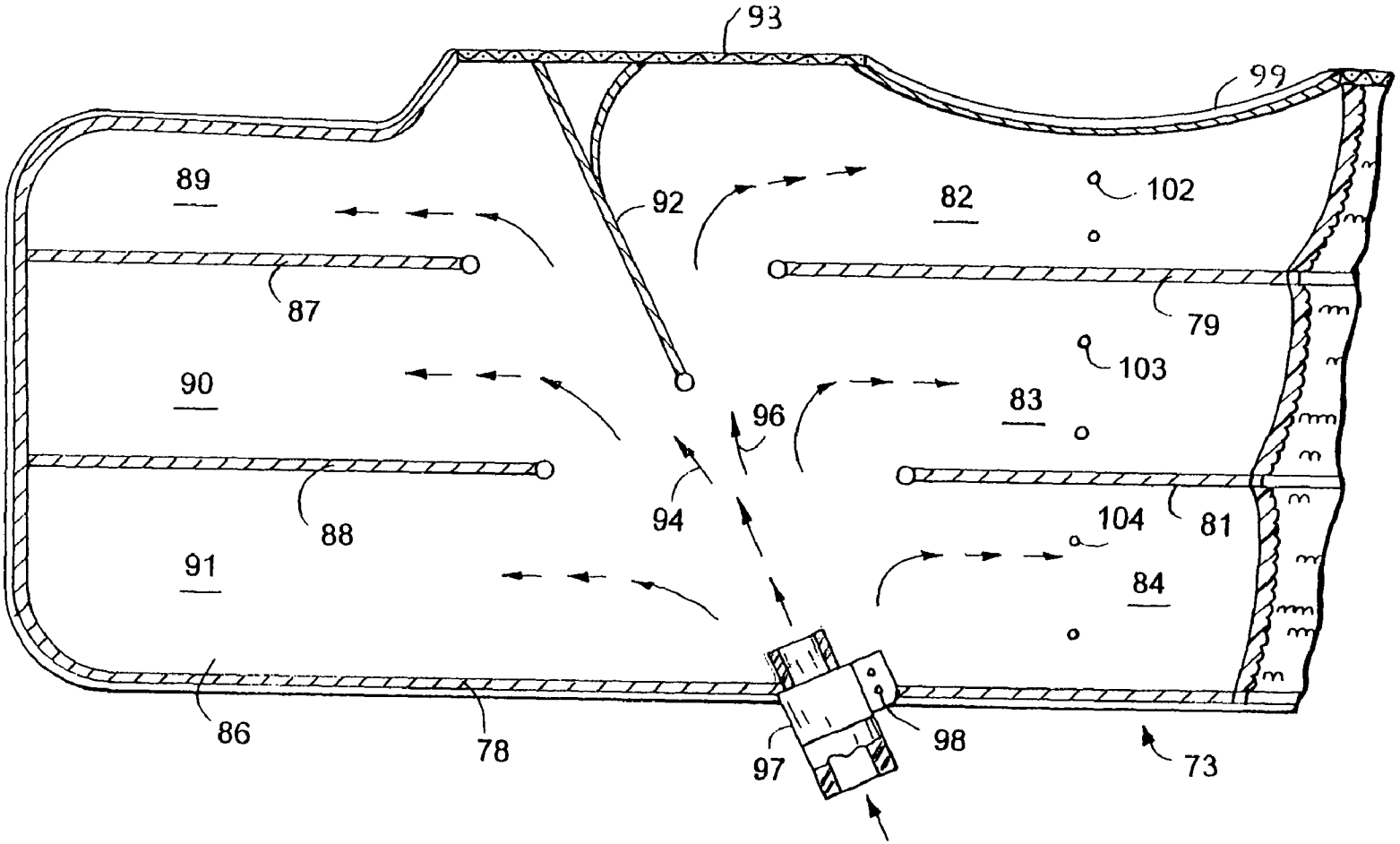
FIG. 9 is an enlarged elevational view, partly sectioned, showing the air pulse inlet section of the thoracic therapy garment of FIG. 1.

As shown in FIGS. 5 and 6, thoracic therapy garment 30 comprises an elongated generally rectangular body 73 including an end flap 74. Body 73, shown in FIGS. 7 and 8, has an inner air impervious flexible member 76 attached to a loop-type fabric member 77. The entire outer surface of member 76 is covered with the loop-type fabric member. The loop fibers can be embedded or fixed into member 76. Member 76 is a flexible plastic layer, such as air impervious urethane plastic. Other types of plastics and materials can be used for air impervious member 76. Returning to FIGS. 5 and 6, body 73 has a longitudinal bottom seam or seal 78 and longitudinal middle seams or seals 79 and 81 which form three longitudinal chambers 82, 83 and 84 for accommodating air. Seams 78, 79 and 81 are linear sonic welds. Heat seals can be used for seams 78, 79 and 81. End 86 of body 73 opposite end 74 has longitudinal seams or seals 87 and 88 longitudinally aligned with seams 79 and 81 which provide air chambers 89, 90 and 91 for air. Seams 79 and 87 and seams 81 and 88 are spaced apart. A diagonal seam or seal 92 extends downwardly from top edge 93 of body 73 to about the middle of body 73. Seam 92, as shown in FIG. 9, is a divider that separates the flow of air shown by arrows 94 and 96 and directs the flow of air into chambers 82, 83, 84, 89, 90 and 91. An air inlet connector 97 secured to the bottom portion of member 76 and seam 78 is adapted to be releasably attached to hose 61. Air flows through connector 97 into body 73. Connector 97 is a tubular member joined to a flange 98 secured to body 73. Other types of hose connectors can be used to accommodate hose 61 and direct air and air pressure pulses into body 73. As shown in FIGS. 1 and 2, connector 97 is coupled to hose 61 when thoracic therapy garment 30 is located clockwise and counterclockwise around the person's thorax. The same connector 97 is coupled to hose 61 when thoracic therapy garment 30 is in reversed use.

Returning to FIGS. 5, 6 and 8, top edge 93 of body 73 has a pair of concave sections 99 and 101 providing recesses or arm contours that increase coverage of the upper thoracic area of the person. The side walls of body 73 below concave sections 99 and 101 have a number of small holes 102-107 for allowing a controlled flow of air from chambers 82, 83 and 84. As shown in FIG. 8, holes 105-107 are open to opposite sides of chambers 82, 83 and 84 to allow air to flow to atmosphere. Air-pulse generator 11 supplies air and air pressure pulses to chambers 82, 83 and 84 and maintains a selected air pressure in chambers 82-84.

Figure 10:
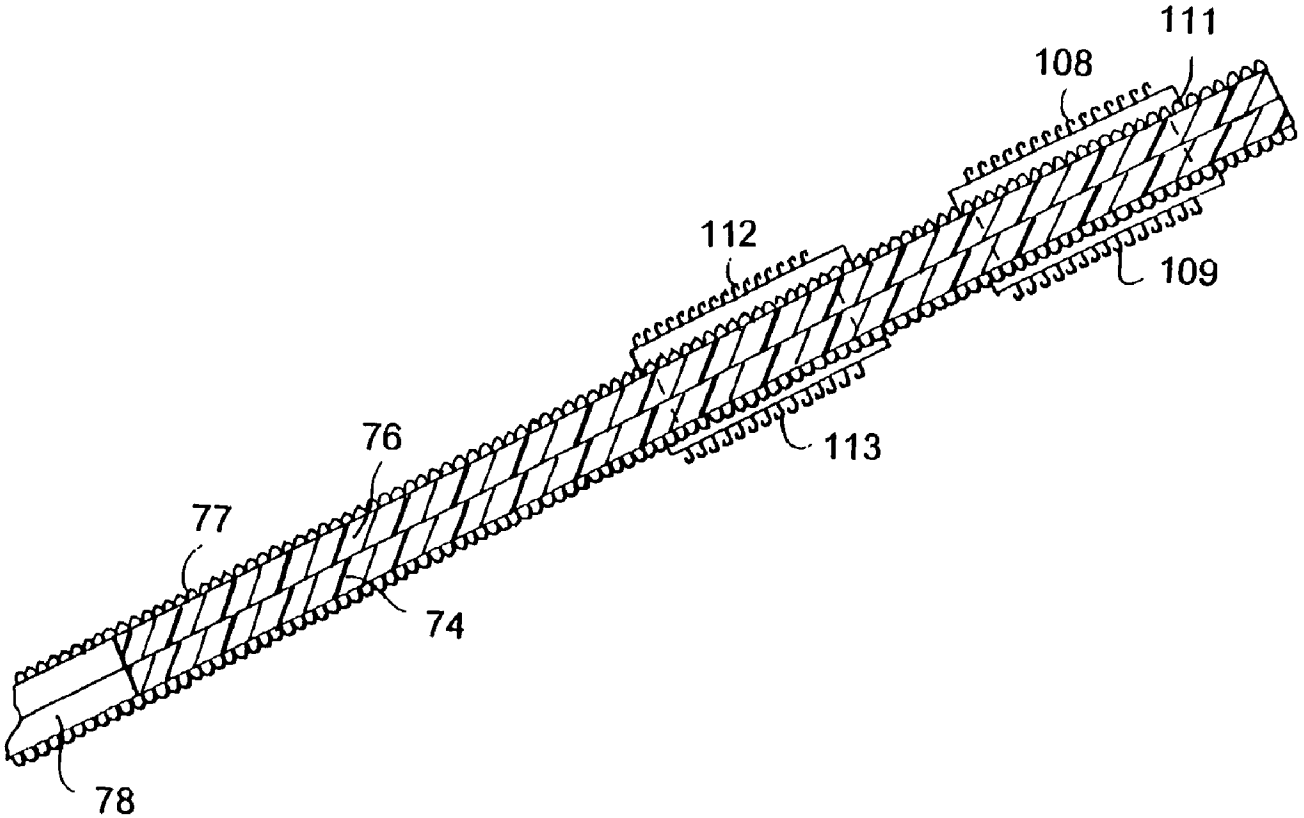
FIG. 10 is an enlarged sectional view taken along the line 10-10 of FIG. 5.

As shown in FIG. 10, a first pair of hook pads 108 and 109 are secured with stitches 111 to opposite sides of end section 74 of body 73. Hook pads 108 and 109, shown in FIGS. 5 and 6, are diagonal generally rectangular releasable fasteners. A second pair of hook pads 112 and 113 are secured with stitches 114 to opposite sides of end section 74 of body 73. Hook pads 108, 109, 112 and 113 can be fastened to opposite sides of end section 74 of body 73 with seams, such as sonic welds or heat seals. In use, hook pads 108 and 109 releasably engage the loop fabric to retain thoracic therapy garment 30 clockwise around a person's thorax. Hook pads 112 and 113 releasably engage the loop fabric when body 73 is reversed to retain thoracic therapy garment 30 counterclockwise around a person's thorax.

Figure 4:
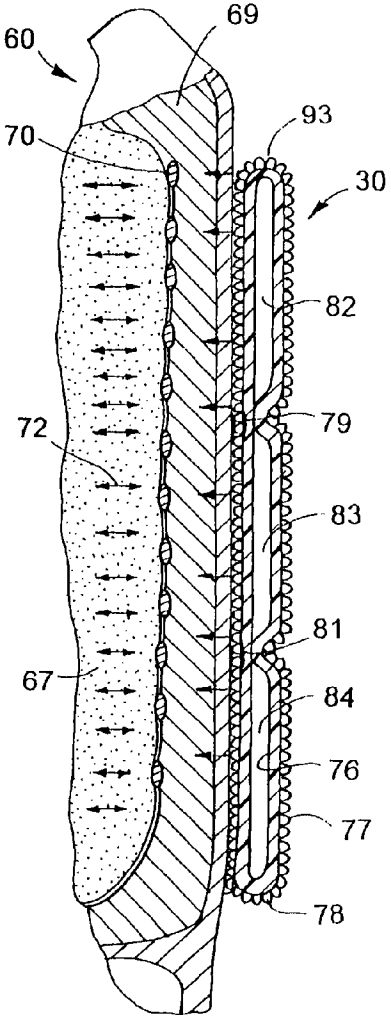
FIG. 4 is an enlarged sectional view of the right side of the person of FIG. 3 with the thoracic therapy garment applying pressure pulses to the person's thorax.
Figure 11:
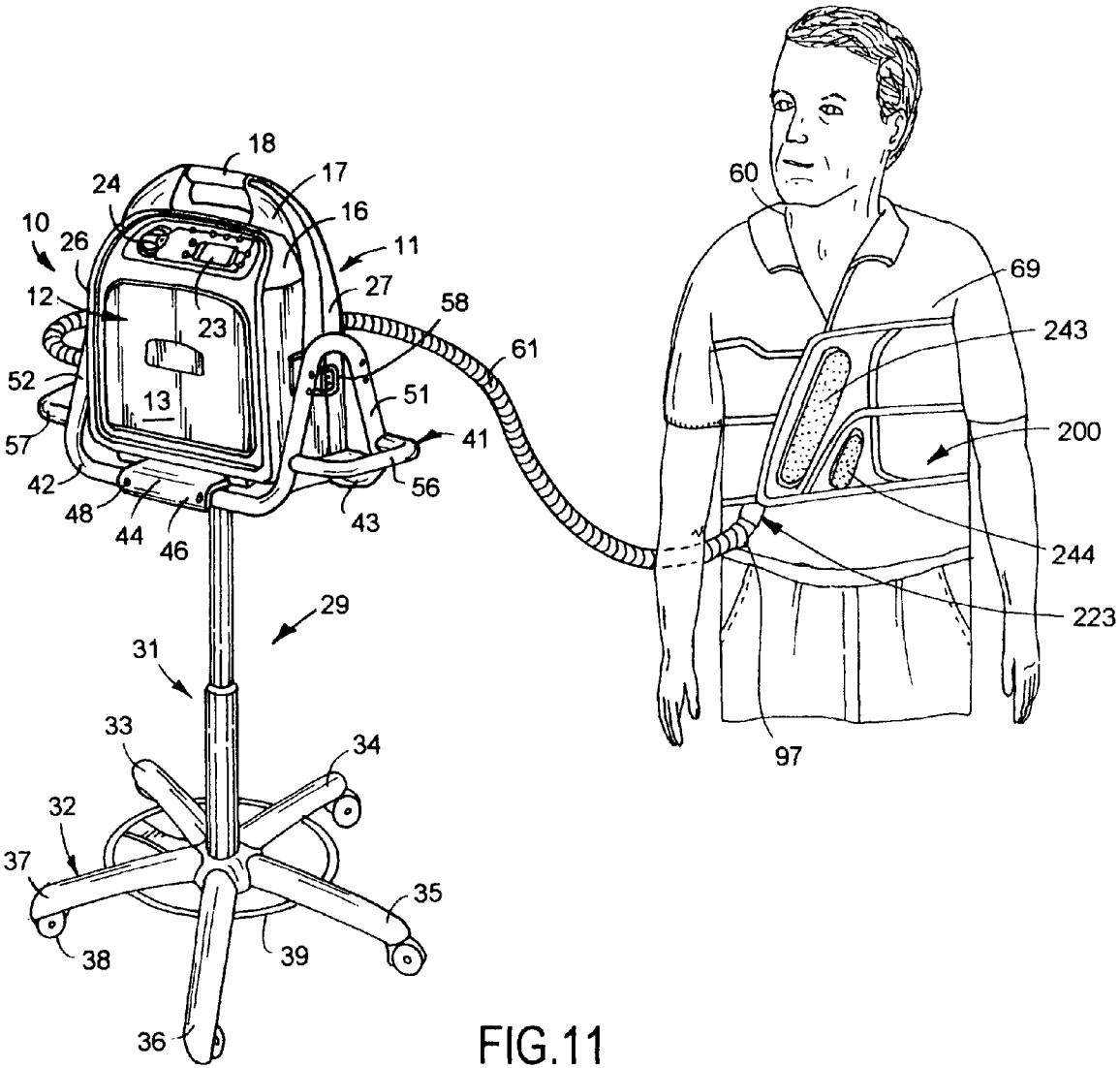
FIG. 11 is a perspective view of a modification of the thoracic therapy garment located around the thorax of a person connected with a hose to a pedestal mounted air-pulse generator.

A modification of the thoracic therapy garment 200, shown in FIG. 11, located around the person's thorax 69 functions to apply repeated high frequency compression or pressure pulses to thorax 69 that delivers to the person effective, convenient and comfortable airway clearance treatment. Thoracic therapy garment 200 has a single hose design that is reversible on a person's thorax to allow access from either side of the person being treated. Environmentally compatible materials are incorporated into thoracic therapy garment 200 allowing garment 200 to be disposed of after a single person use. Thoracic therapy garment 200 has the same functions as thoracic therapy garment 30 described herein and shown in FIGS. 3 and 4.

Figure 12:
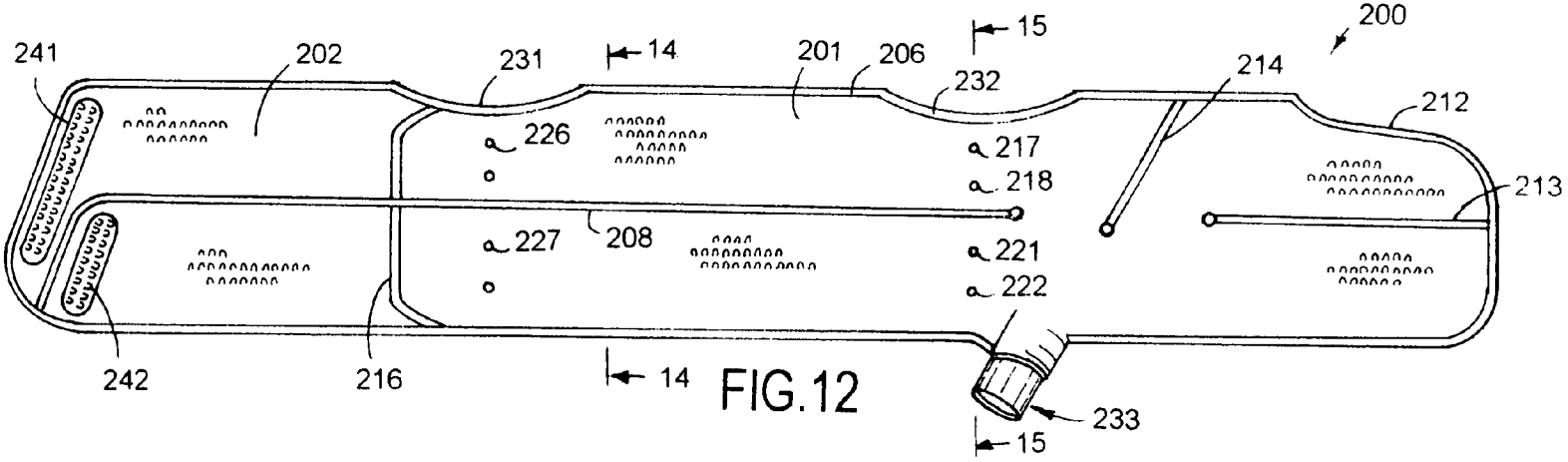
FIG. 12 is a linear front elevational view of the thoracic therapy garment of FIG. 11.
Figure 13:
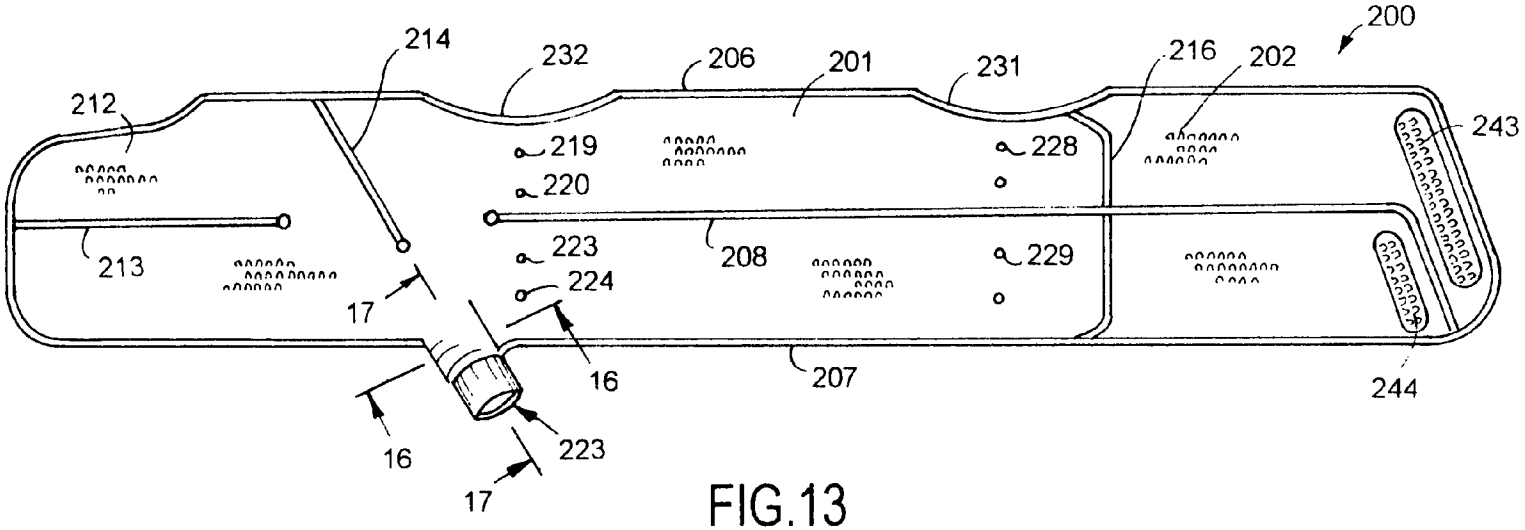
FIG. 13 is a linear rear elevational view of the thoracic therapy garment of FIG. 11.
Figure 14:
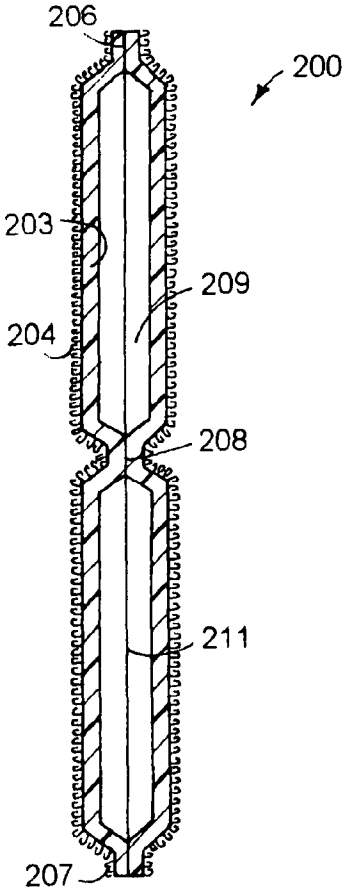
FIG. 14 is an enlarged sectional view taken along line 14-14 of FIG. 12.

As shown in FIGS. 12 and 13, thoracic therapy garment 200 has an elongated generally rectangular and flexible body 201 having opposite end sections 202 and 212. Body 201, shown in FIGS. 14 and 15, has an inner air impervious flexible member 203 having an outer surface connected to a loop-type fabric member 204. The loop-type fabric member 204 located on opposite sides of body 201 covers the entire front and back surfaces of body 201. Fabric member 204 can be loop fibers embedded in or fixed to member 203. Member 203 is a flexible plastic layer, such as air impervious urethane plastic. Other types of plastics and materials can be used for air impervious member 203. The front and back sections of body 201 are connected with outer peripheral seams or seals 206 and 207. A horizontal middle seam or seal 208 divides the interior of body 201 into two horizontal chambers 209 and 211 for accommodating air and air pressure pulses. A second horizontal seam or seal 213 in end section 212 is horizontally aligned with seam 208. Seam 213 is spaced from seam 208 to provide a passage 215, shown in FIG. 18, between chambers 209 and 211. A diagonal seam or seal 214 extends from top seam or seal 206 midway through chamber 209 and passage 215 into chamber 211. Seam 214 divides air and air pressure pulses flowing out of tubular connector 223, shown by arrows 247, 248, 249 and 250, into chambers 209 and 211. Tubular connector 223 is releasably connected to the air discharge end of hose 61, as shown in FIG. 11. A vertical seam or seal 216 separates end section 202 from chambers 209 and 211. End section 202 has front and rear portions secured together, as shown by end members 74 and 76 in FIG. 10. Seams 206, 207, 208, 213, 214 and 216 are sonic welds. Heat seals can also be used for these seams.

Figure 15:
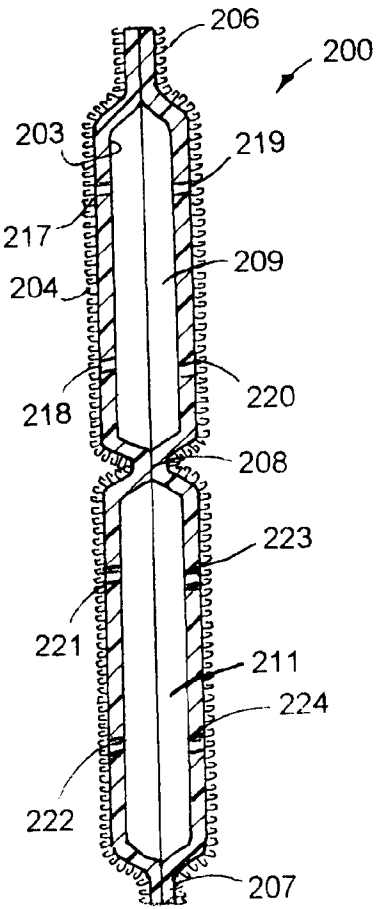
FIG. 15 is an enlarged sectional view taken along line 15-15 of FIG. 12.

Returning to FIGS. 12 and 13, the top edge of body 201 has a pair of longitudinally spaced concave sections 231 and 232 providing recesses or arm contours that increase coverage of the upper thoracic area of the person. The side walls of body 201 below concave sections 231 and 232 have a number of small holes 217 to 224 and 226 to 229 for allowing a controlled flow of air from chambers 209 and 211. As shown in FIG. 15, holes 217 to 224 are open to opposite sides of chambers 209 and 211 to allow air to flow out of body 201 to atmosphere. Air-pulse generator 11 operates to supply air and air pressure pulses to air chambers 209 and 211 in an amount to maintain a selected air pressure in chambers 209 and 211 with air flowing through holes 217 to 224 and 226 to 229 to atmosphere.

Figure 17:
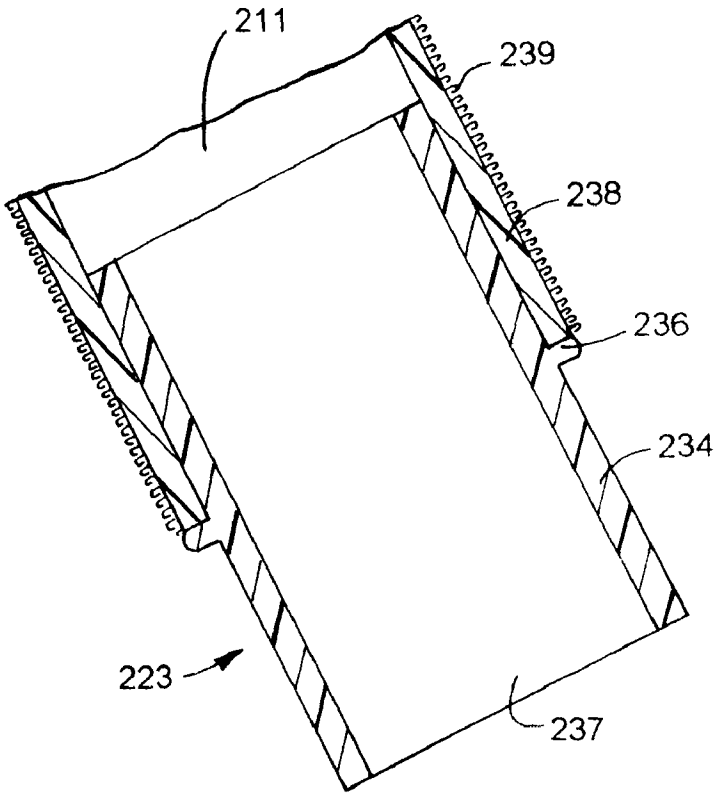
FIG. 17 is an enlarged sectional view taken along line 17-17 of FIG. 13.
Figure 16:
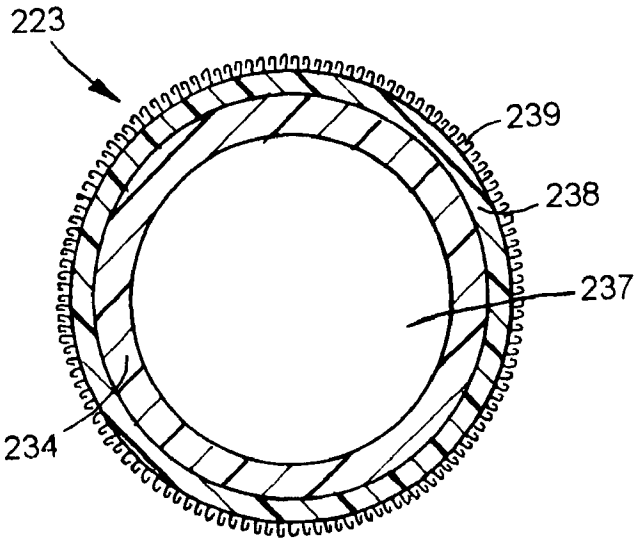
FIG. 16 is an enlarged sectional view taken along line 16-16 of FIG. 13.
Figure 18:
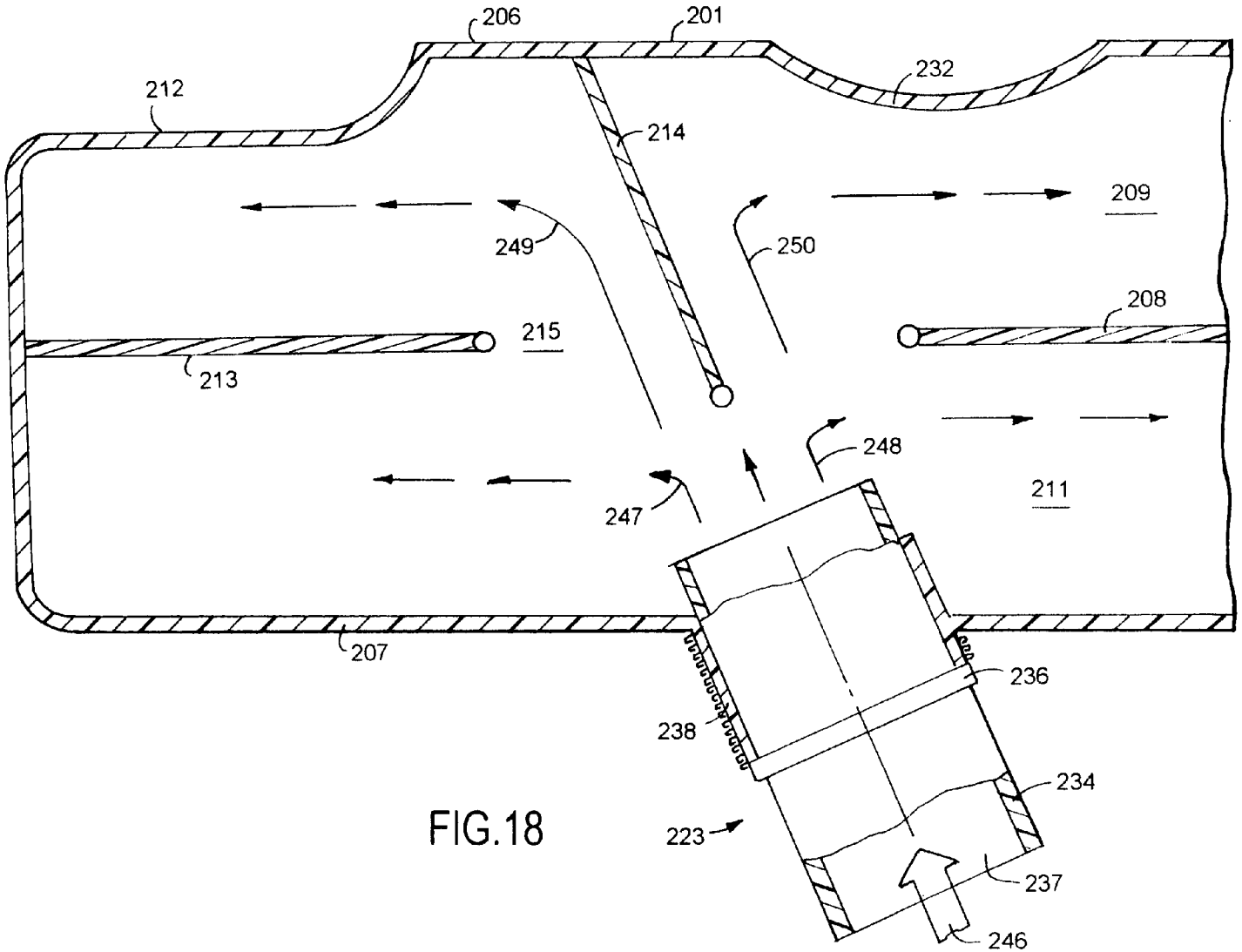
FIG. 18 is an enlarged sectional view, partly sectioned, showing the air pulse inlet sections of the thoracic therapy garment of FIG. 11.

Tubular connector 223, shown in FIGS. 16 to 18, has a tubular member 234 having an annular outer rib 236 and a passage 237. Rib 236 extends outwardly from the middle of tubular member 234. Body 201 has a sleeve section 238 surrounding and bonded with an adhesive to the inner part of tubular member 234. The air outlet end of hose 61 has a cylindrical nozzle that telescopes into passage 237 of tubular member 234 whereby air, shown by arrow 246, flows into passage 237 and chambers 209 and 211.

As shown in FIGS. 12 and 13, a first pair of hook pads 241 and 242 are secured to the front side of the end section 202 of body 201. Pads 241 and 242 are elongated fiber hook members located adjacent and aligned with the end of end section 202. Outer hook pad 241 is longer than inner hook pad 242. A second pair of hook pads 243 and 244 are secured to the back side of the end section 202 of body 201 opposite hook pads 241 and 242. The front and rear arrangement of hook pads 241, 242, 243 and 244 follows the hook pads 108, 109, 112 and 113 shown in FIG. 10. Hook pads 241 to 244 can be fastened to opposite sides of end section 202 of body 201 with stitches, sonic welds or heat seals. In use, hook pads 241 and 242 releasably engage loop fabric member 204 to retain thoracic therapy garment 200 clockwise around a person's thorax. Hook pads 243 and 244 releasably engage loop fabric member 204 when body 201 is reversed to retain thoracic therapy garment 200 counterclockwise around a person's thorax.

There has been shown and described an embodiment of a portable air-pulse generator connected to thoracic therapy garments for applying high frequency pressure pulses to a person's thorax. Changes in the structure, materials and arrangement of structure can be made by persons skilled in the art without departing from the invention.

The invention claimed is:

1. A thoracic therapy garment useable with an air pulse generator for applying pressure pulses to the thorax of a person comprising:

a body having a flexible air impervious member having oppositely facing sides and loop members joined to said oppositely facing sides of the air impervious member;

said air impervious member surrounding a plurality of chambers for accommodating air and air pressure pulses;

an air inlet connector secured to the body having a passage open to said chambers to allow air and air pressure pulses to flow into said chambers;

said body including an end section having oppositely facing sides; and hook members secured to the oppositely facing sides of the end section of the body that coact with the loop members to retain the body around the thorax of a person, said body being reversible whereby the hook members on the oppositely facing sides of the end section of the body coact with the loop members to selectively retain the thoracic therapy garment clockwise or counterclockwise around the thorax of a person, whereby when the garment is secured in a clockwise direction one of the oppositely facing sides is located against the thorax of the person and when the garment is secured in a counterclockwise direction the other of the oppositely facing sides is located against the thorax of the person.

2. The thoracic therapy garment of claim 1 including:

seams dividing the body into three chambers; and a divider located within the body operable to direct air and air pressure pulses flowing from the passage of the air inlet connector into said three chambers.

3. The thoracic therapy garment of claim 1 wherein:

said body has a longitudinal dimension and spaced longitudinal seams dividing the body into longitudinal chambers; and a divider extended between the spaced longitudinal seams within the body operable to direct air and air pressure pulses flowing from the passage of the air inlet connector into said chambers.

4. The thoracic therapy garment of claim 1 wherein:

said body includes a top section having concave recesses providing contours for a person's arms.

5. The thoracic therapy garment of claim 1 wherein:

said body includes a plurality of holes to allow air to flow out of said chambers.

6. The thoracic therapy garment of claim 1 wherein:

the opposite sides of the air impervious member has a plurality of holes to allow air to flow out of said chambers.

7. The thoracic therapy garment of claim 1 wherein:

said hook members comprise a pair of hook pads located on each oppositely facing side of the end section of the body; and fasteners securing the pair of hook pads to the end section of the body.

8. The thoracic therapy garment of claim 1 including:

at least one seam dividing the body into two chambers for accommodating air and air pressure pulses; and a divider located within the body for directing air and air pressure pulses flowing from the passage of the air inlet connector into said two chambers.

9. The thoracic therapy garment of claim 8 wherein:

said body includes a top section having downwardly extended concave recesses providing contours for a person's arms.

10. The thoracic therapy garment of claim 9 wherein:

the opposite sides of the air impervious member have a plurality of holes located below the concave recesses to allow air to flow out of said chambers.

11. The thoracic therapy garment of claim 9 wherein:

the hook members comprise a pair of hook pads secured to each oppositely facing side of the end section of the body.

12. A thoracic therapy garment useable with an air pulse generator for applying pressure pulses to the thorax of a person comprising:

a body having a flexible air impervious member having oppositely facing sides and loop members joined to said oppositely facing sides of the air impervious member;

said air impervious member surrounding a plurality of chambers for accommodating air and air pressure pulses;

an air inlet connector secured to the body having a passage open to said chambers to allow air and air pressure pulses to flow into said chambers;

a divider located within the body operable to direct air and air pressure pulses flowing from the passage of the air inlet connector into said chambers;

said body including a top edge having downwardly directed concave recesses providing contours for a person's arms;

at least one of said sides of the air impervious member having a plurality of holes to allow air to flow out of the chamber; and an end section having oppositely facing sides; and hook members secured to the oppositely facing sides of the end section of the body operable to coact with the loop members to retain the body around the thorax of a person;

said body being reversible whereby the hook members on the oppositely facing sides of the end section of the body coact with the loop members to selectively retain the thoracic therapy garment clockwise or counterclockwise around the thorax of a person, whereby when the garment is secured in a clockwise direction one of the oppositely facing sides is located against the thorax of the person and when the garment is secured in a counterclockwise direction the other of the oppositely facing sides is located against the thorax of the person.

13. The thoracic therapy garment of claim 12 including:

longitudinally spaced seams dividing the body into longitudinal chambers;

said dividers extended between said spaced seams toward the passage of the air inlet connector operable to direct air and air pressure pulses into said chambers.

14. The thoracic therapy garment of claim 12 including: horizontal seams dividing the body into three chambers.

15. The thoracic therapy garment of claim 12 including: a horizontal seam dividing the body into two chambers.

16. The thoracic therapy garment of claim 12 wherein: the hook members comprise a pair of hook pads secured to each side of the end section of the body.

* * * * *